US008721474B2

(12) United States Patent
Ohama et al.

(10) Patent No.: US 8,721,474 B2
(45) Date of Patent: May 13, 2014

(54) GOLF BALL

(75) Inventors: Keiji Ohama, Kobe (JP); Hirotaka Nakamura, Kobe (JP); Kazuya Kamino, Kobe (JP)

(73) Assignee: SRI Sports Limited, Kobe-Shi (JP)

( * ) Notice: Subject to any disclaimer, the term of this patent is extended or adjusted under 35 U.S.C. 154(b) by 438 days.

(21) Appl. No.: 12/542,277

(22) Filed: Aug. 17, 2009

(65) Prior Publication Data

US 2010/0069174 A1 Mar. 18, 2010

(30) Foreign Application Priority Data

Sep. 16, 2008 (JP) ..... 2008-235838
Nov. 21, 2008 (JP) ..... 2008-297486

(51) Int. Cl.
*A63B 37/06* (2006.01)

(52) U.S. Cl.
USPC ..... 473/376

(58) Field of Classification Search
CPC ..... A63B 37/0062; A63B 37/0065; A63B 37/0076
USPC ..... 473/376, 373, 374
See application file for complete search history.

(56) References Cited

U.S. PATENT DOCUMENTS 6,271,296 B1 8/2001 Nakamura et al.
6,468,169 B1 10/2002 Hayashi et al.
6,478,696 B1 11/2002 Yamagishi et al.
2002/0013184 A1 1/2002 Morgan
2002/0037778 A1 3/2002 Nakamura et al.
2003/0119989 A1 6/2003 Ladd et al.
2003/0166422 A1 9/2003 Kato et al.
2004/0029648 A1 2/2004 Kato
2004/0033847 A1* 2/2004 Higuchi et al. ..... 473/371
2004/0077434 A1 4/2004 Matroni et al.
2004/0077435 A1 4/2004 Matroni et al.
2006/0025242 A1 2/2006 Yokota et al.
2007/0281801 A1 12/2007 Watanabe et al.
2009/0091060 A1 4/2009 Yokota et al.

FOREIGN PATENT DOCUMENTS

JO 2006-34691 A 2/2006
JP 2000-350795 A 12/2000
JP 2001-17571 A 1/2001
JP 2001-17573 A 1/2001

(Continued)

OTHER PUBLICATIONS

Japanese Office Action, dated Apr. 17, 2012, for Japanese Application No. 2008-297486.

*Primary Examiner* — Raeann Gorden
(74) *Attorney, Agent, or Firm* — Birch, Stewart, Kolasch & Birch, LLP

(57) ABSTRACT

A golf ball 2 has a core 4, an inner cover 6 positioned outside the core 4 and an outer cover 8 positioned outside the inner cover 6. The core 4 has a spherical center 10 and a mid layer 12 positioned outside the center 10. The center 10 has a diameter of 1 mm or greater and 15 mm or less. A difference (H4–H3) between a JIS-C hardness H4 of a surface of the core and a JIS-C hardness H3 of an innermost part of the mid layer is equal to or greater than 10. The hardness H4 is greater than a JIS-C hardness H2 of a surface of a spherical body including the core 4 and the inner cover 6. A Shore D hardness H7 of the outer cover 8 is less than 40.

21 Claims, 1 Drawing Sheet

(56) References Cited

FOREIGN PATENT DOCUMENTS

| | | | |
|---|---|---|---|
| JP | 2002-272880 | A | 9/2002 |
| JP | 2003-79766 | A | 3/2003 |
| JP | 2004-41734 | A | 2/2004 |
| JP | 2005-533614 | A | 11/2005 |
| JP | 2007-319660 | A | 12/2007 |

* cited by examiner

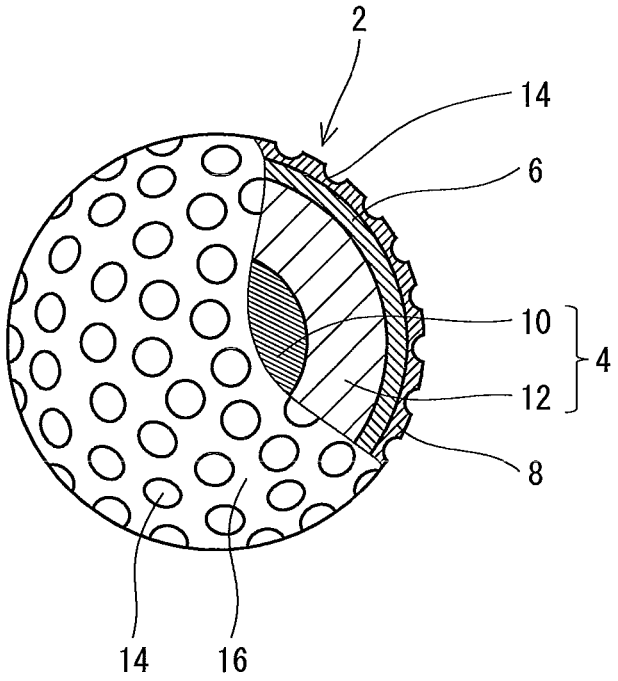
2
14
6
10
4
12
8
14
16

GOLF BALL

This application claims priority on Patent Application No. 2008-235838 filed in JAPAN on Sep. 16, 2008, and Patent Application No. 2008-297486 filed in JAPAN on Nov. 21, 2008. The entire contents of the Japanese Patent Applications are hereby incorporated by reference.

BACKGROUND OF THE INVENTION

1. Field of the Invention

The present invention relates to golf balls. More particularly, the present invention relates to multi-piece golf balls having a center, a mid layer, an inner cover and an outer cover.

2. Description of the Related Art

Golf players' greatest demand for golf balls is flight performance. Golf players emphasize flight performance with a driver, a long iron and a middle iron. The flight performance is correlated with the resilience performance of the golf ball. When the golf ball excellent in resilience performance is hit, the golf ball flies at a fast speed to accomplish great flight distance. The flight performance is further correlated with spin rate. The golf ball flies at a small spin rate, thereby obtaining proper trajectory to accomplish great flight distance. In light of flight performance, golf balls which have high resilience performance and are not likely to be spun are desired. Golf players further emphasize feel at impact. Golf players prefer soft feel at impact.

Further, golf players emphasize also spin performance of golf balls. If a backspin rate is high, the run is short. By using a golf ball which has a high backspin rate, golf players can let the golf ball to stop at a target point. By using a golf ball which has a high sidespin rate, golf players can intentionally let the golf ball to curve. A golf ball with excellent spin performance has excellent controllability. In particular, high-level golf players place importance on controllability of a shot with a short iron.

A variety of golf balls having a multi-layer structure have been proposed. U.S. Pat. No. 6,468,169 (JP-A-10-328326) discloses a golf ball having an inner core, a surrounding layer, an inner cover and an outer cover. U.S. Pat. No. 6,271,296 (JP-A-2001-17575) discloses a golf ball having a core, a surrounding layer, a middle layer and a cover. JP-A-2002-272880 discloses a golf ball having a core and a cover. The core has a center and an outer core layer. The cover has an inner cover layer and an outer cover layer. US2003/166422 (JP-A-2003-205052) discloses a golf ball having a center, a mid layer and a cover. US2004/29648 (JP-A-2004-130072) discloses a golf ball having a core and a cover. The core has a three-layered construction.

When a golf ball has an outer-hard/inner-soft structure, the spin upon a shot with a driver may be suppressed. The conventional golf ball uses a soft center, a hard mid layer and a hard cover in order to attain the outer-hard/inner-soft structure. In this golf ball, the hardness distribution up to the central point of a center from the surface of a mid layer has a large level difference on the boundary of the center and the mid layer. This level difference deteriorates the suppression of spin. A soft center deteriorates the resilience performance. A hard cover deteriorates feel at impact. Further, the hard cover deteriorates controllability upon a shot with a short iron.

Golf players' demand to the golf ball has been increasingly escalating. It is an object of the present invention to provide a golf ball excellent in various performances.

SUMMARY OF THE INVENTION

A golf ball according to the present invention includes a core, an inner cover positioned outside the core and an outer cover positioned outside the inner cover. The core has a center and a mid layer positioned outside the center. The center has a diameter of 1 mm or greater and 15 mm or less. A difference (H4−H3) between a JIS-C hardness H4 of a surface of the core and a JIS-C hardness H3 of an innermost part of the mid layer is equal to or greater than 10. The hardness H4 is equal to or greater than 75 and equal to or less than 95. The hardness H4 is greater than a JIS-C hardness H2 of a surface of the center. A JIS-C hardness H6 of a surface of a spherical body including a core and an inner cover is greater than the hardness H4. A Shore D hardness H7 of the outer cover is less than 40.

In the golf ball according to the present invention, the center, the mid layer and the inner cover accomplished an outer-hard/inner-soft structure. In this golf ball, the diameter of the center is small and the hardness difference (H4−H3) of the mid layer is large. Therefore, the level difference of the hardness on the boundary of the center and the mid layer is small. The conventional golf ball has an outer-hard/inner-soft structure having inferior continuity of hardness distribution. On the other hand, the golf ball according to the present invention has an outer-hard/inner-soft structure having excellent continuity of hardness distribution. In this golf ball, the spin is sufficiently suppressed upon shots with a driver, a long iron and a middle iron. The center does not deteriorate resilience performance of the golf ball since the diameter of the center is small. The outer cover contributes to feel at impact of the golf ball since the hardness of the outer cover is small. The outer cover contributes also to controllability upon a shot with a short iron. This golf ball is excellent in flight performance, feel at impact and controllability.

Preferably, the center has a central point having a JIS-C hardness H1 of equal to or greater than 20 and equal to or less than 50. The hardness H2 is preferably equal to or greater than 25 and equal to or less than 70. A difference (H2−H1) is preferably equal to or greater than 1 and equal to or less than 15.

Preferably, the hardness H3 is equal to or greater than 45 and equal to or less than 75. Preferably, a difference (H3−H2) between the hardness H3 and the hardness H2 is equal to or greater than 0 and equal to or less than 35. Preferably, a difference (H4−H1) between the hardness H4 and the hardness H1 of the central point of the center is equal to or greater than 40 and equal to or less than 65. Preferably, a difference (H4−H2) between the hardness H4 and the hardness H2 is equal to or greater than 20 and equal to or less than 60. Preferably, the difference (H4−H3) is equal to or less than 25.

Preferably, a Shore D hardness H5 of the inner cover is equal to or greater than 55 and equal to or less than 80. Preferably, a hardness H6 is equal to or greater than 85 and equal to or less than 98. Preferably, a difference (H6−H4) between the hardness H6 and the hardness H4 is equal to or greater than 1 and equal to or less than 20. Preferably, a harness H7 is equal to or greater than 10 and equal to or less than 40.

Preferably, the core has a diameter of equal to or greater than 28.00 mm and equal to or less than 40.2 mm. Preferably, the mid layer has a thickness of equal to or greater than 10 mm and equal to or less than 20 mm. Preferably, the inner cover has a thickness of 1.5 mm or less. Preferably the outer cover has a thickness of less than 0.8 mm.

An amount of compressive deformation of the center is equal to or greater than 0.5 mm and equal to or less than 2.5 mm in the case where an initial load is 0.3N and a final load is 29.4N. Preferably, the amount of compressive deformation of the center is equal to or greater than 2.3 mm and equal to or less than 4.0 mm in the case where the initial load is 98N and the final load is 1274N. Preferably the amount of the compressive deformation of the spherical body including the core and the inner cover is equal to or greater than 2.3 mm and equal to or less than 4.0 mm in the case where the initial load is 98N and the final load is 1274N. Preferably, the amount of compressive deformation of the golf ball is equal to or greater than 2.0 mm and equal to or less than 3.5 mm in the case where the initial load is 98N and the final load is 1274N.

The mid layer may be formed by crosslinking of a rubber composition. Preferably, a base rubber of the rubber composition contains polybutadiene as a principal component.

BRIEF DESCRIPTION OF THE DRAWINGS

FIG. 1 is a partially cutaway plan view of a golf ball according to an embodiment of the preset invention, showing a cross-section of the golf ball.

DESCRIPTION OF THE PREFERRED EMBODIMENTS

The present invention will be hereinafter described in detail with appropriate references to the accompanying drawing, according to preferred embodiments.

A golf ball 2 shown in FIG. 1 has a spherical core 4, an inner cover 6 positioned outside the core 4 and an outer cover 8 positioned outside the inner cover 6. The core 4 has a spherical center 10 and a mid layer 12 positioned outside the center 10. Numerous dimples 14 are formed on the surface of the outer cover 8. Of the surface of the golf ball 2, a part other than the dimples 14 is land 16. This golf ball 2 has a paint layer and a mark layer on the external surface side of the outer cover 8, although these layers are not shown in the Figure.

The golf ball 2 has a diameter of 40 mm or greater and 45 mm or less. From the standpoint of conformity to the rules defined by United States Golf Association (USGA), the diameter is preferably equal to or greater than 42.67 mm. In light of suppression of the air resistance, the diameter is preferably equal to or less than 44 mm, and more preferably equal to or less than 42.80 mm. The golf ball 2 has a weight of 40 g or greater and 50 g or less. In light of attainment of great inertia, the weight is preferably equal to or greater than 44 g, and more preferably equal to or greater than 45.00 g. From the standpoint of conformity to the rules defined by USGA, the weight is preferably equal to or less than 45.93 g.

The center 10 is obtained by crosslinking a rubber composition. Illustrative examples of preferable base rubber include polybutadienes, polyisoprenes, styrene-butadiene copolymers, ethylene-propylene-diene copolymers and natural rubbers. In light of resilience performance, polybutadienes are preferred. When other rubber is used in combination with polybutadiene, it is preferred that polybutadiene is included as a principal component. Specifically, it is preferred that the percentage of polybutadiene in the entire base rubber is equal to or greater than 50% by weight, and more preferably equal to or greater than 80% by weight. Preferably, polyurethanes have a perecentage of cis-1,4 bonds of equal to or greater than 40%, and more preferably equal to or greater than 80%.

The rubber composition of the center 10 contains sulfur. The sulfur crosslinks rubber molecules mutually. The center 10 obtained by the sulfur crosslinking is soft. The center 10 accomplishes an outer-hard/inner-soft structure of the core 4. The core 4 suppresses the spin upon shots with a driver, a long iron and a middle iron. The core 4 contributes also to feel at impact.

In light of the resilience performance of the golf ball 2, the amount of sulfur per 100 parts by weight of the base rubber is preferably equal to or greater than 2.0 parts by weight, and particularly preferably equal to or greater than 3.0 parts by weight. In light of the soft of the center 10, the amount of sulfur is preferably equal to or less than 10.0 parts by weight, and particularly preferably equal to or less than 6.5 parts by weight.

Preferably, the rubber composition of the center 10 contains a vulcanization accelerator. The vulcanization accelerator accomplishes the short crosslinking time of the center 10. A guanidine vulcanization accelerator, a thiazole vulcanization accelerator, a sulfenamide vulcanization accelerator, an aldehyde ammonia vulcanization accelerator, a thiourea vulcanization accelerator, a thiuram vulcanization accelerator, a dithiocarbamate vulcanization accelerator, a xanthate vulcanization accelerator and the like may be used. The guanidine vulcanization accelerator, the thiazole vulcanization accelerator and the sulfenamide vulcanization accelerator are preferred. Two or more kinds of vulcanization accelerators may be used in combination.

Illustrative examples of the guanidine vulcanization accelerator include 1,3-diphenylguanidine, 1,3-di-o-tolylguanidine, 1-o-tolylbiguanide and di-o-tolylguanidine salt of dicatechol borate. Specific examples of 1,3-diphenylguanidine include trade names "NOCCELER D" and "NOCCELER D-P", available from Ouchi Shinko Chemical Industrial Co., Ltd.; and trade names "SOXINOL D", "SOXINOL DG" and "SOXINOL DO", available from Sumitomo Chemical Co., Ltd. Specific examples of 1,3-di-o-tolylguanidine include trade name "NOCCELER DT", available from Ouchi Shinko Chemical Industrial Co., Ltd.; and trade names "SOXINOL DT" and "SOXINOL DT-O", available from Sumitomo Chemical Co., Ltd. Specific examples of 1-o-tolylbiguanide include trade name "NOCCELER BG", available from Ouchi Shinko Chemical Industrial Co., Ltd. Specific examples of di-o-tolylguanidine salt of dicatechol borate include trade name "NOCCELER PR", available from Ouchi Shinko Chemical Industrial Co., Ltd.

Illustrative examples of the thiazole vulcanization accelerator include 2-mercaptobenzothiazole, di-2-benzothiazolyl disulfide, 2-mercaptobenzothiazole zinc salt, 2-mercaptobenzothiazole cyclohexylamine salt, 2-(N,N-diethylthiocarbamoylthio)benzothiazole and 2-(4'-morpholinodithio)benzothiazole. Specific examples of 2-mercaptobenzothiazole include trade names "NOCCELER M" and "NOCCELER M-P", available from Ouchi Shinko Chemical Industrial Co., Ltd. Specific examples of di-2-benzothiazolyl disulfide include trade names "NOCCELER DM" and "NOCCELER DM-P", available from Ouchi Shinko Chemical Industrial Co., Ltd. Specific examples of 2-mercaptobenzothiazole zinc salt include trade name "NOCCELER MZ", available from Ouchi Shinko Chemical Industrial Co., Ltd. Specific examples of 2-mercaptobenzothiazole cyclohexylamine salt include trade name "NOCCELER M-60-OT", available from Ouchi Shinko Chemical Industrial Co., Ltd. Specific examples of 2-(N,N-diethylthiocarbamoylthio)benzothiazole include trade name "NOCCELER 64", available from Ouchi Shinko Chemical Industrial Co., Ltd. Specific examples of 2-(4'-morpholinodithio)benzothiazole include trade names "NOCCELER MDB" and "NOCCELER MDB-P", available from Ouchi Shinko Chemical Industrial Co., Ltd.

Illustrative examples of the sulfenamide vulcanization accelerator include N-cyclohexyl-2-benzothiazolylsulfenamide, N-tert-butyl-2-benzothiazolylsulfenamide, N-oxydiethylene-2-benzothiazolylsulfenamide and N,N'-dicyclohexyl-2-benzothiazolylsulfenamide. Specific examples of N-cyclohexyl-2-benzothiazolylsulfenamide include trade names "NOCCELER CZ" and "NOCCELER CZ-G", available from Ouchi Shinko Chemical Industrial Co., Ltd. Specific examples of N-tert-butyl-2-benzothiazolylsulfenamide include trade names "NOCCELER NS" and "NOCCELER NS-P", available from Ouchi Shinko Chemical Industrial Co., Ltd. Specific examples of N-oxydiethylene-2-benzothiazolylsulfenamide include trade name "NOCCELER MSA-G", available from Ouchi Shinko Chemical Industrial Co., Ltd. Specific examples of N,N'-dicyclohexyl-2-benzothiazolylsulfenamide include trade names "NOCCELER DZ" and "NOCCELER DZ-G", available from Ouchi Shinko Chemical Industrial Co., Ltd.

The amount of the vulcanization accelerator per 100 parts by weight of the base rubber is preferably equal to or greater than 0.5 parts by weight, and particularly preferably equal to or greater than 2.0 parts by weight. The amount of the vulcanization accelerator is preferably equal to or less than 7.0 parts by weight, and particularly preferably equal to or less than 5.0 parts by weight.

Generally, a rubber composition of a center of a golf ball contains an organic peroxide. The organic peroxide contributes to the resilience performance of the golf ball. On the other hand, the organic peroxide increases the hardness of the center. The center 10 of the golf ball 2 shown in FIG. 1 does not contain the organic peroxide. The rubber composition provides the soft center 10. The rubber composition may include a small amount of organic peroxide.

Preferably, a reinforcing material is blended into the center 10. Preferable reinforcing material is silica (white carbon). Silica may accomplish the moderate rigidity of the center 10. Dried silica and wet silica may be used. In light of the rigidity of the center 10, the amount of silica per 100 parts by weight of the base rubber is preferably equal to or greater than 5 parts by weight, and particularly preferably equal to or greater than 10 parts by weight. In light of the soft of the center 10, the amount of silica is preferably equal to or less than 40 parts by weight, and particularly preferably equal to or less than 30 parts by weight. Together with silica, a silane coupling agent may be blended.

Into the center 10 may be blended a filler for the purpose of adjusting specific gravity and the like. Illustrative examples of suitable filler include zinc oxide, barium sulfate, calcium carbonate and magnesium carbonate. Powder of a highly dense metal may be also blended as the filler. Specific examples of the highly dense metal include tungsten and molybdenum. The amount of the filler is determined ad libitum so that the intended specific gravity of the center 10 can be accomplished. Particularly preferable filler is zinc oxide. Zinc oxide serves not only to adjust the specific gravity but also as a crosslinking activator.

Various kinds of additives such as an anti-aging agent, a coloring agent, a plasticizer, a dispersant, co-crosslinking agent, an organic sulfur compound and the like may be blended in an adequate amount to the center 10 as needed. Into the center 10 may be also blended crosslinked rubber powder or synthetic resin powder.

In light of the durability, the central hardness HI of the center 10 is preferably equal to or greater than 20, more preferably equal to or greater than 25, and particularly preferably equal to or greater than 30. In light of the suppression of the spin, the central hardness H1 is preferably equal to or less than 50, more preferably equal to or less than 45, and particularly preferably equal to or less than 40. The central hardness H1 is measured by pressing a JIS-C type hardness scale on a cutting surface obtained by cutting the center 10 into halves. For the measurement, an automated rubber hardness tester (trade name "P1", available from KOBUNSHI KEIKI CO., LTD.) which is equipped with this hardness scale is used.

The hardness of the center 10 increases gradually toward the surface from the central point. The surface hardness H2 of the center 10 is larger than the central hardness H1. The larger surface hardness H2 may accomplish the continuity of the hardness between the center 10 and the mid layer 12. In this respect, the surface hardness H2 of the center 10 is preferably equal to or greater than 25, more preferably equal to or greater than 30, and particularly preferably equal to or greater than 35. In light of the feel at impact, the surface hardness H2 is preferably equal to or less than 70, more preferably equal to or less than 65, much more preferably equal to or less than 60, and particularly preferably equal to or less than 55. The surface hardness is measured by pressing a JIS-C type hardness scale on the surface of the center 10. For the measurement, an automated rubber hardness tester (trade name "P1", available from KOBUNSHI KEIKI CO., LTD.) which is equipped with this hardness scale is used.

In light of feel at impact, the difference (H2−H1) between the surface hardness H2 and the central hardness H1 is preferably equal to or greater than 1, more preferably equal to or greater than 3, and particularly preferably equal to or greater than 5. In light of resilience performance, the difference (H2−H1) is preferably equal to or less than 15, more preferably equal to or less than 10, and particularly equal to or less than 7.

In light of feel at impact, an amount of compressive deformation of the center 10 is preferably equal to or greater than 0.5 mm, more preferably equal to or greater than 1.0 mm, and particularly preferably equal to or greater than 1.1 mm. In light of resilience performance, the amount of compressive deformation is preferably equal to or less than 2.5 mm, more preferably equal to or less than 2.3 mm, and particularly preferably equal to or less than 2.0 mm.

Upon measurement of the amount of compressive deformation, the spherical body is placed on a hard plate made of metal. A cylinder made of metal gradually descends toward the spherical body. The spherical body intervened between the bottom face of the cylinder and the hard plate is deformed. A migration distance of the cylinder, starting from the state in which initial load is applied to the spherical body up to the state in which final load is applied thereto, is the amount of compressive deformation. Upon measurement of the amount of compressive deformation of the center 10, the initial load is 0.3N, and the final load is 29.4N. Upon measurements of an amount of the compressive deformation of the core 4, an amount of the compressive deformation of the spherical body including the core 4 and the inner cover 6 and an amount of compressive deformation of the golf ball 2, the initial load is 98N, and the final load is 1274N.

The diameter of the center 10 is smaller than a center of a general golf ball. The smaller center 10 may form the sufficiently thick mid layer 12. The mid layer 12 may accomplish an outer-hard/inner-soft structure having excellent continuity of hardness distribution. The smaller center 10 suppresses the spin. The smaller center 10 does not deteriorate the resilience performance of the golf ball 2, irrespective of being soft. In light of the continuity of hardness distribution and the resilience performance, the diameter of the center 10 is preferably equal to or less than 15 mm, more preferably equal to or less than 14 mm, much more preferably equal to or less than 10 mm, and particularly preferably equal to or less 9 mm. In light of the center 10 capable of contributing to the suppression of the spin, the diameter of the center 10 is preferably equal to or greater than 1 mm, more preferably equal to or greater than 2 mm, much more preferably equal to or greater than 3 mm, and particularly preferably equal to or greater than 5 mm.

The weight of the center 10 is preferably 0.05 g or greater and 3 g or less. The crosslinking temperature of the center 10 is usually 140° C. or greater and 180° C. or less. The crosslinking time of the center 10 is usually 5 minutes or longer and 60 minutes or less. The center 10 may have two or more layers. The center 10 may have a surface provided with a rib.

The mid layer 12 is formed by crosslinking a rubber composition. Illustrative examples of preferable base rubber include polybutadienes, polyisoprenes, styrene-butadiene copolymers, ethylene-propylene-diene copolymers and natural rubbers. In light of resilience performance, polybutadienes are preferred. When other rubber is used in combination with polybutadiene, it is preferred that polybutadiene is included as a principal component. Specifically, a proportion of polybutadiene in the entire base rubber is preferably equal to or greater than 50% by weight, and more preferably equal to or greater than 80% by weight. Preferably, polyurethane has a proportion of cis-1,4 bonds of equal to or greater than 40%, and more preferably equal to or greater than 80%.

For crosslinking of the mid layer 12, a co-crosslinking agent is preferably used. Preferable examples of the co-crosslinking agent in light of the resilience performance include monovalent or bivalent metal salts of an α,β-unsaturated carboxylic acid having 2 to 8 carbon atoms. Specific examples of the preferable co-crosslinking agent include zinc acrylate, magnesium acrylate, zinc methacrylate and magnesium methacrylate. Zinc acrylate and zinc methacrylate are particularly preferred in light of the resilience performance.

As the co-crosslinking agent, an α,β-unsaturated carboxylic acid having 2 to 8 carbon atoms and a metal oxide may be also blended. Both components react in the rubber composition to give a salt. This salt contributes to the crosslinking reaction. Examples of preferable α,β-unsaturated carboxylic acid include acrylic acid and methacrylic acid. Examples of preferable metal oxide include zinc oxide and magnesium oxide.

In light of the resilience performance of the golf ball 2, the amount of the co-crosslinking agent per 100 parts by weight of the base rubber is preferably equal to or greater than 10 parts by weight, more preferably equal to or greater than 15 parts by weight, and particularly preferably equal to or greater than 20 parts by weight. In light of soft feel at impact, the amount of the co-crosslinking agent per 100 parts by weight of the base rubber is preferably equal to or less than 50 parts by weight, more preferably equal to or less than 45 parts by weight, and particularly preferably equal to or less than 40 parts by weight.

Preferably, the rubber composition for use in the mid layer 12 includes the organic peroxide together with the co-crosslinking agent. The organic peroxide serves as a crosslinking initiator. The organic peroxide contributes to the resilience performance of the golf ball 2. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide. In light of general versatility, dicumyl peroxide is preferred.

In light of the resilience performance of the golf ball 2, the amount of the organic peroxide per 100 parts by weight of the base rubber is preferably equal to or greater than 0.1 parts by weight, more preferably equal to or greater than 0.3 parts by weight, and particularly preferably equal to or greater than 0.5 parts by weight. In light of soft feel at impact, the amount of the organic peroxide per 100 parts by weight of the base rubber is preferably equal to or less than 3.0 parts by weight, more preferably equal to or less than 2.8 parts by weight, and particularly preferably equal to or less than 2.5 parts by weight.

Preferably, the rubber composition for use in the mid layer 12 includes an organic sulfur compound. Illustrative examples of preferable organic sulfur compound include mono-substituted forms such as diphenyl disulfide, bis(4-chlorophenyl)disulfide, bis(3-chlorophenyl)disulfide, bis(4-bromophenyl)disulfide, bis(3-bromophenyl)disulfide, bis(4-fluorophenyl)disulfide, bis(4-iodophenyl)disulfide and bis(4-cyanophenyl)disulfide; di-substituted forms such as bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide and bis(2-cyano-5-bromophenyl)disulfide; tri-substituted forms such as bis(2,4,6-trichlorophenyl)disulfide and bis(2-cyano-4-chloro-6-bromophenyl)disulfide; tetra-substituted forms such as bis(2,3,5,6-tetrachlorophenyl)disulfide; and penta-substituted forms such as bis(2,3,4,5,6-pentachlorophenyl)disulfide and bis (2,3,4,5,6-pentabromophenyl)disulfide. The organic sulfur compound contributes to the resilience performance. Particularly preferred organic sulfur compounds are diphenyl disulfide and bis(pentabromophenyl)disulfide.

In light of the resilience performance of the golf ball 2, the amount of the organic sulfur compound per 100 parts by weight of the base rubber is preferably equal to or greater than 0.1 parts by weight, and more preferably equal to or greater than 0.2 parts by weight. In light of soft feel at impact, the amount of the organic sulfur compound per 100 parts by weight of the base rubber is preferably equal to or less than 1.5 parts by weight, more preferably equal to or less than 1.0 parts by weight, and particularly preferably equal to or less than 0.8 parts by weight.

Into the mid layer 12 may be blended a filler for the purpose of adjusting specific gravity and the like. Illustrative examples of suitable filler include zinc oxide, barium sulfate, calcium carbonate and magnesium carbonate. Powder of a highly dense metal may be also blended as the filler. Specific examples of the highly dense metal include tungsten and molybdenum. The amount of the filler is determined ad libitum so that the intended specific gravity of the mid layer 12 can be accomplished. Particularly preferable filler is zinc oxide. Zinc oxide serves not only to adjust the specific gravity but also as a crosslinking activator. Various kinds of additives such as sulfur, an anti-aging agent, a coloring agent, a plasticizer, a dispersant and the like may be blended in an adequate amount to the mid layer 12 as needed. Into the mid layer 12 may be also blended crosslinked rubber powder or synthetic resin powder.

The mid layer 12 has a hardness gradually increasing to the surface (i.e., to the surface of the core 4) from the innermost part. The hardness H3 of the innermost part is small, and the hardness H4 of the surface is large. The small hardness H3 may accomplish the continuity of the hardness between the center 10 and the mid layer 12. The large hardness H4 accomplishes the outer-hard/inner-soft structure of the core 4. The mid layer 12 suppresses the spin sufficiently upon shots with a driver, a long iron and a middle iron.

In light of the resilience performance, the hardness H3 of the innermost part is preferably equal to or greater than 45, more preferably equal to or greater than 50, much more preferably equal to or greater than 55, and particularly preferably equal to or greater than 63. In light of the continuity of hardness distribution, the hardness H3 of the innermost part is preferably equal to or less than 75, more preferably equal to or less than 70, and particularly preferably equal to or less than 67. The hardness H3 is measured in a hemispherical body obtained by cutting the core 4. The hardness H3 is measured by pressing a JIS-C type hardness scale on the cutting surface of the hemispherical body. The hardness scale is pressed on an area surrounded by a first circle and a second circle. The first circle is a boundary between the center 10 and the mid layer 12. The second circle, which is concentric to the first circle, has a radius larger by 1 mm than that of the first circle. For the measurement, an automated rubber hardness tester (trade name "P1", available from KOBUNSHI KEIKI CO., LTD.) which is equipped with this hardness scale is used.

In light of an outer-hard/inner-soft structure being accomplished, the surface hardness H4 of the core 4 is preferably equal to or greater than 65, more preferably equal to or greater than 75, much more preferably equal to or greater than 80, and particularly preferably equal to or greater than 85. In light of feel at impact, the hardness H4 is preferably equal to or less than 95, more preferably equal to or less than 93, much more preferably equal to or less than 92, and particularly preferably equal to or less than 90. The hardness H4 is measured by pressing the JIS-C type hardness scale on the surface of the core 4. For the measurement, an automated rubber hardness tester (trade name "P1", available from KOBUNSHI KEIKI CO., LTD.) which is equipped with this hardness scale is used.

In light of suppression of the spin, the difference (H4−H3) between the hardness H4 of the surface of the core 4 and the hardness H3 of the innermost part of the mid layer 12 is preferably equal to or greater than 10, more preferably equal to or greater than 13, and particularly preferably equal to or greater than 14. In light of ease in manufacture, the difference (H4−H3) is preferably equal to or less than 25, more preferably equal to or less than 20, and particularly preferably equal to or less than 18.

In light of the larger difference (H4−H3) capable of being accomplished, the thickness of the mid layer 12 is preferably equal to or greater than 10 mm, more preferably equal to or greater than 11 mm, and particularly preferably equal to or greater than 12 mm. The thickness is preferably equal to or less than 20 mm, more preferably equal to or less than 19 mm, and particularly preferably equal to or less than 18 mm.

In molding the mid layer 12, the center 10 is covered with two half shells each in a state of unvulcanized or semi-vulcanized. The heating causes a crosslinking reaction to complete the molding of the mid layer 12. The crosslinking temperature of the mid layer 12 is usually 140° C. or greater and 180° C. or less. The crosslinking time of the mid layer 12 is usually 10 minutes or longer and 60 minutes or less.

In light of continuity of hardness distribution, the difference (H3−H2) between the hardness H3 of the innermost part of the mid layer 12 and the surface hardness H2 of the center 10 is preferably equal to or less than 35 and more preferably equal to or less than 33. The difference (H3−H2) may be zero.

In light of the suppression of the spin, the difference (H4−H1) between the hardness H4 of the surface of the core 4 and the central hardness H1 of the center 10 is preferably equal to or greater than 40, more preferably equal to or greater than 43, and particularly preferably equal to or greater than 46. In light of ease in manufacture, the difference (H4−H1) is preferably equal to or less than 65, more preferably equal to or less than 60, and particularly preferably equal to or less than 51.

In light of feel at impact, the amount of compressive deformation of the core 4 is preferably equal to or greater than 2.3 mm, more preferably equal to or greater than 2.4 mm, and particularly preferably equal to or greater than 2.5 mm. In light of resilience performance, the amount of compressive deformation is preferably equal to or less than 4.0 mm, more preferably equal to or less than 3.9 mm, and particularly preferably equal to or less than 3.8 mm.

In light of the resilience performance, the core 4 has a diameter of preferably equal to or greater than 28.0 mm, more preferably equal to or greater than 30.0 mm, and particularly preferably equal to or greater than 32.0 mm. In light of durability of the golf ball 2, the core 4 has a diameter of preferably equal to or less than 40.2 mm, more preferably equal to or less than 39.9 mm, and particularly preferably equal to or less than 39.6 mm.

A resin composition is suitably used for the inner cover 6. Illustrative examples of the base polymer of the resin composition include an ionomer resin, styrene block-containing thermoplastic elastomer, thermoplastic polyester elastomer, thermoplastic polyamide elastomer and thermoplastic polyolefin elastomer.

The ionomer resin is particularly preferred as the base polymer. The ionomer resin is highly elastic. As described later, the outer cover 8 of the golf ball 2 is thin and flexible. Thus, the inner cover is greatly deformed when the golf ball 2 is hit with a driver. The inner cover 6 including the inomer resin contributes to resilience performance upon a shot with a driver. The ionomer resin and other resin may be used in combination. When they are used in combination, in light of resilience performance, a proportion of the ionomer resin in the entire base polymer is preferably equal to or greater than 50% by weight, more preferably equal to or greater than 70% by weight, and particularly preferably equal to or greater than 85%.

Examples of preferred ionomer resin include binary copolymers formed with α-olefin and an α,β-unsaturated carboxylic acid having 3 to 8 carbon atoms. Preferable binary copolymer includes 80% by weight or greater and 90% by weight or less of α-olefine and 10% by weight or greater and 20% by weight or less of α,β-unsaturated carboxylic acid. This binary copolymer provides excellent resilience performance. Examples of preferable other ionomer resins include ternary copolymers formed with α-olefine, an α,β-unsaturated carboxylic acid having 3 to 8 carbon atoms, and an α,β-unsaturated carboxylate ester having 2 to 22 carbon atoms. Preferable ternary copolymer comprises 70% by weight or greater and 85% by weight or less of α-olefin, 5% by weight or greater 30% by weight or less of α,β-unsaturated carboxylic acid, and 1% by weight or greater and 25% by weight or less of α,β-unsaturated carboxylate ester. This ternary copolymer has excellent resilience performance. In the binary and ternary copolymers, preferable α-olefin is ethylene and propylene, and preferable α,β-unsaturated carboxylic acid is acrylic acid and methacrylic acid. Particularly preferred ionomer resin is a copolymer formed with ethylene, and acrylic acid or methacrylic acid.

In the binary and ternary copolymers, a part of the carboxyl groups is neutralized with a metal ion. Illustrative examples of the metal ion for use in neutralization include sodium ion, potassium ion, lithium ion, zinc ion, calcium ion, magnesium ion, aluminum ion and neodymium ion. The neutralization may be carried out with two or more kinds of metal ions. Particularly suitable metal ion in light of the resilience performance and durability of the golf ball 2 is sodium ion, zinc ion, lithium ion and magnesium ion.

Specific examples of the ionomer resin include trade names "Himilan 1555", "Himilan 1557", "Himilan 1605", "Himilan 1706", "Himilan 1707", "Himilan 1856", "Himilan 1855", "HimilanAM7311", "Himilan AM7315","HimilanAM7317", "Himilan AM7318", "Himilan AM7329", "Himilan MK7320" and "Himilan MK7329", available from DuPont-MITSUI POLYCHEMICALS Co., Ltd.; trade names "Surlyn 6120", "Surlyn 6910", "Surlyn 7930", "Surlyn 7940", "Surlyn 8140", "Surlyn 8150", "Surlyn 8940", "Surlyn 8945", "Surlyn 9120", "Surlyn 9150", "Surlyn 9910", "Surlyn 9945", "Surlyn AD8546", "HPF 1000" and "HPF 2000", available from Du Pont Kabushiki Kaisha; and trade names "IOTEK 7010", "IOTEK 7030", "IOTEK 7510", "IOTEK 7520", "IOTEK 8000" and "IOTEK 8030", available from EXXON Mobil Chemical Corporation.

Two or more kinds of the ionomer resins may be used in combination into the inner cover 6. An ionomer resin neutralized with a monovalent metal ion, and an ionomer resin neutralized with a bivalent metal ion may be used in combination.

The preferable resin which may be used in combination with the ionomer resin is the styrene block-containing thermoplastic elastomer. This elastomer may contribute to feel at impact of the golf ball 2. The elastomer does not deteriorate the resilience performance of the golf ball 2. The elastomer includes a polystyrene block as a hard segment, and a soft segment. Typical soft segment is a diene block. Illustrative examples of a diene block compounds include butadiene, isoprene, 1,3-pentadiene and 2,3-dimethyl-1,3-butadiene. Butadiene and isoprene are preferred. Two or more compounds may be used in combination.

The styrene block-containing thermoplastic elastomer may include a styrene-butadiene-styrene block copolymer (SBS), a styrene-isoprene-styrene block copolymer (SIS), a styrene-isoprene-butadiene-styrene block copolymer (SIBS), a hydrogenated product of SBS, a hydrogenated product of SIS or a hydrogenated product of SIBS. Example of hydrogenated product of SBS is a styrene-ethylene-butylene-styrene block copolymer (SEBS). Exemplary hydrogenated product of SIS is a styrene-ethylene-propylene-styrene block copolymer (SEPS). Exemplary hydrogenated product of SIBS is a styrene-ethylene-ethylene-propylene-styrene block copolymer (SEEPS).

In light of the resilience performance of the golf ball 2, the content percentage of the styrene component in the thermoplastic elastomer is preferably equal to or greater than 10% by weight, more preferably equal to or greater than 12% by weight, and particularly preferably equal to or greater than 15% by weight. In light of the feel at impact of the golf ball 2, the content percentage is preferably equal to or less than 50% by weight, more preferably equal to or less than 47% by weight, and particularly preferably equal to or less than 45% by weight.

In the present invention, the styrene block-containing thermoplastic elastomer includes an alloy of olefin with one or more selected from the group consisting of SBS, SIS, SIBS, SEBS, SEPS and SEEPS, and hydrogenated products thereof. The olefin component in this alloy is speculated to contribute to improvement of the compatibility with the ionomer resin. When this alloy is used, the resilience performance of the golf ball 2 is improved. Preferably, olefin having 2 to 10 carbon atoms is used. Illustrative examples of suitable olefin include ethylene, propylene, butene and pentene. Ethylene and propylene are particularly preferred.

Specific examples of the polymer alloy include trade names "Rabalon T3221C", "Rabalon T3339C", "Rabalon SJ4400N", "Rabalon SJ5400N", "Rabalon SJ6400N", "Rabalon SJ7400N", "Rabalon SJ8400N", "Rabalon SJ9400N" and "Rabalon SR04", available from Mitsubishi Chemical Corporation. Other specific examples of the styrene block-containing thermoplastic elastomer include a trade name "Epofriend A1010", available from DAICEL CHEMICAL INDUSTRIES, LTD.; and a trade name "Septon HG-252", available from KURARAY CO., LTD.

When the ionomer resin and the styrene block-containing thermoplastic elastomer is used in combination into the inner cover 6, the weight ratio of both is preferably equal to or greater than 50/50 and equal to or less than 97/3. The inner cover 6 having the ratio of equal to or greater than 50/50 contributes to the resilience performance of the golf ball 2. In this light, the ratio is more preferably equal to or greater than 70/30, and particularly preferably equal to or greater than 85/15. The inner cover 6 having the ratio of equal to or less than 97/3 contributes to feel at impact. In this light, the ratio is more preferably equal to or less than 95/10.

The inner cover 6 may include highly elastic resin. Illustrative examples of the highly elastic resin include polybutylene terephthalates, polyphenylene ethers, polyethylene terephthalates, polysulfones, polyethersulfones, polyphenylene sulfides, polyarylates, polyamide-imides, polyetherimides, polyetheretherketones, polyimides, polytetrafluoroethylenes, polyaminobismaleimides, polybisamide-triazole, polyphenylene oxides, polyacetals, polycarbonates, acrylonitrile-butadiene-styrene copolymers and acrylonitrile-styrene copolymers. Polymer alloy of polyphenylene ether with polyamide may be used. Illustrative examples of preferable polymer alloy include an alloy of polyphenylene ether with polyamide 6, and an alloy of polyphenylene ether with polyamide 66. Specific example of the alloy of polyphenylene ether with polyamide 6 includes "LEMALLOY BX505", available from Mitsubishi Engineering-Plastic Corporation. The alloy has a flexural modulus of 2200 Mpa. When the ionomer resin and the highly elastic resin are used in combination for the inner cover 6, the ratio of both is equal to or greater than 50/50 and equal to or less than 95/5, and more preferably equal to or less than 65/35 and more preferably equal to or less than 90/10.

Into the inner cover 6 may be blended a coloring agent such as titanium dioxide, a filler such as barium sulfate, a dispersant, an antioxidant, an ultraviolet absorbent, a light stabilizer, a fluorescent agent, a fluorescent brightening agent and the like in an appropriate amount as needed. Known techniques such as injection molding and compression molding may be adopted for the formation of the inner cover 6.

In light of the resilience performance, the hardness H5 of the inner cover 6 is preferably equal to or greater than 55, more preferably equal to or greater than 60, and particularly preferably equal to or greater than 65. In light of the feel at impact, the hardness H5 is preferably equal to or less than 80, and particularly preferably equal to or less than 75.

The hardness H5 may be measured in accordance with a standard of "ASTM-D 2240-68" by using a D type shore spring hardness scale attached to an automated rubber hardness tester (trade name "P1", available from KOBUNSHI KEIKI CO., LTD.). For the measurement, a slab formed by hot pressing to have a thickness of about 2 mm is used. Prior to the measurement, the slab is stored at a temperature of 23° C. for two weeks. When the measurement is carried out, three pieces of the slab are overlaid. In the measurement, a slab constituted with the same resin composition as that of the inner cover 6 is used.

In light of suppression of spin upon shots with a driver, a long iron and a middle iron, the inner cover 6 has the thickness of preferably equal to or greater than 0.3 mm, more preferably equal to or greater than 0.5 mm, and particularly preferably equal to or greater than 0.6 mm. In light of the feel at impact, the thickness is preferably equal to or less than 1.5 mm, more preferably equal to or less than 1.3 mm, and particularly preferably equal to or less than 1.1 mm.

In light of an attainment of an outer-hard/inner-soft structure, a surface hardness H6 of the spherical body including the core 4 and the inner cover 6 is preferably equal to or greater than 85, more preferably equal to or more than 88, and particularly preferably equal to or greater than 90. In light of feel at impact, the hardness H6 is preferably equal to or less than 98, and particularly preferably equal to or less than 97. The hardness H6 is measured by pressing a JIS-C type hardness scale on the surface of the spherical body. For the measurement, an automated rubber hardness tester (trade name "P1", available from KOBUNSHI KEIKI CO., LTD.) which is equipped with this hardness scale is used.

In light of feel at impact, the amount of compressive deformation of the spherical body including the core 4 and the inner cover 6 is preferably equal to or greater than 2.3 mm, more preferably equal to or greater than 2.4 mm, and particularly preferably equal to or greater than 2.5 mm. In light of the resilience performance, the amount of compressive deformation is preferably equal to or less than 4.0 mm, more preferably equal to or less than 3.9 mm, and particularly preferably equal to or less than 3.8 mm.

The outer cover 8 is made of a resin composition. Examples of the base polymer of this resin composition include polyurethanes, polyesters, polyamides, polyolefins, polystyrenes and ionomer resins. Polyurethanes are particularly preferred. Polyurethanes are flexible. When the golf ball 2 with the outer cover 8 including polyurethane is hit with a short iron, the spin rate is high. The outer cover 8 made of polyurethane contributes to the controllability of shots with a short iron. Polyurethane contributes also to scuff resistance of the outer cover 8.

When the golf ball 2 is hit with a driver, a long iron or a middle iron, the spherical body including the core 4 and the inner cover 6 is greatly deformed since a head speed is great. Since the spherical body has an outer-hard/inner-soft structure, spin rate is suppressed. The suppression of spin rate accomplishes great flight distance. The deformation of the spherical body when the golf ball 2 is hit with a short iron is small since the head speed is small. Behavior of the golf ball when it is hit with a short iron depends mainly on the outer cover 8. Since the outer cover 8 is flexible, great spin rate can be obtained. The great spin rate accomplishes excellent controllability. The golf ball 2 achieves both flight performance upon a shot with a driver, a long iron and a middle iron and controllability upon a shot with a short iron.

The outer cover 8 absorbs the shock when the golf ball 2 is hit. This absorption achieves soft feel at impact. Particularly, the outer cover 8 achieves excellent feel at impact when the golf ball 2 is hit with a short iron or a putter.

For the outer cover 8, polyurethane and other resin may be used in combination. In this case, in light of spin performance and feel at impact, the polyurethane is a principal component of the base polymer. The proportion of the amount of the polyurethane to the entire base polymer is preferably equal to or greater than 50% by weight, more preferably equal to or greater than 70% by weight, and particularly preferably equal to or greater than 85% by weight.

For the outer cover 8, thermoplastic polyurethanes and thermosetting polyurethanes can be used. In light of productivity, thermoplastic polyurethanes are preferred. A thermoplastic polyurethane includes a polyurethane component as a hard segment, and a polyester component or a polyether component as a soft segment. Examples of the curing agent for the polyurethane component include alicyclic diisocyanates, aromatic diisocyanates and aliphatic diisocyanates. Alicyclic diisocyanates are particularly preferred. Because an alicyclic diisocyanate does not have any double bond in the main chain, the alicyclic diisocyanate suppresses yellowing of the outer cover 8. Additionally, because the alicyclic diisocyanate is excellent in strength, the outer cover 8 can be prevented from being scuffed. Two or more types of diisocyanates may be used in combination.

Examples of alicyclic diisocyanates include 4,4'-dicyclohexylmethane diisocyanate ($H_{12}$MDI), 1,3-bis(isocyanatemethyl)cyclohexane ($H_6$XDI), isophorone diisocyanate (IPDI) and trans-1,4-cyclohexane diisocyanate (CHDI). In light of versatility and processability, $H_{12}$MDI is preferred.

Examples of aromatic diisocyanates include 4,4'-diphenylmethane diisocyanate (MDI) and toluene diisocyanate (TDI). One example of aliphatic diisocyanates is hexamethylene diisocyanate (HDI).

Specific examples of thermoplastic polyurethanes include trade names "Elastollan XNY80A", "Elastollan XNY85A", "Elastollan XNY90A", "Elastollan XNY97A", "Elastollan XNY585" and "Elastollan XKP016N", available from BASF Japan Ltd.; and trade names "RESAMINE P4585LS" and "RESAMINE PS62490", available from Dainichiseika Color & Chemicals Mfg. Co., Ltd.

The outer cover 8 may be formed of a composition including thermoplastic polyurethane and an isocyanate compound. During or after forming the outer cover 8, the polyurethane is crosslinked with the isocyanate compound.

Into the outer cover 8 may be blended with a coloring agent such as titanium dioxide, a filler such as barium sulfate, a dispersant, an antioxididant, an ultraviolet absorbent, a light stabilizer, a fluorescent agent, a fluorescent brightening agent and the like in an appropriate amount as needed.

The hardness H7 of the outer cover 8 is less than 40. By adopting a flexible outer cover 8, favorable controllability upon a shot with a short iron may be achieved. In light of controllability, the hardness H7 is more preferably equal to or less than 35, much more preferably equal to or less than 32, and particularly preferably equal to or less than 30. When the hardness is extremely small, flight performance upon a shot with a driver becomes insufficient. In this respect, the hardness is preferably equal to or greater than 10, and particularly preferably equal to or greater than 15. In the measurement, a slab constituted with the same resin composition as that of the outer cover 8 is used. The measurement is carried out in a same manner to the hardness H5 of the inner cover 6.

In light of flight performance upon a shot with a driver, the thickness of the outer cover 8 is preferably less than 0.8 mm, more preferably equal to or less than 0.6 mm, much more preferably equal to or less than 0.5 mm, and particularly preferably equal to or less than 0.4 mm. In light of controllability upon a shot with a short iron, the thickness is preferably equal to or greater than 0.10 mm, and particularly preferably equal to or greater than 0.15 mm.

Known techniques such as injection molding and compression molding may be adopted for the formation of the outer cover 8. In molding the outer cover 8, dimples 14 are formed by multiple pimples formed in a cavity surface of a mold.

This golf ball 2 satisfies the following formula.

$$H2<H4<H6$$

H2: JIS-C hardness of the surface of the center 10

H4: JIS-C hardness of the surface of the core 4

H6: JIS-C hardness of the surface of the spherical body including the core 4 and the inner cover 6 This golf ball 2 has an outer-hard/inner-soft structure having excellent continuity of hardness distribution. In this golf ball 2, the spin upon shots with a driver, a long iron and a middle iron is sufficiently suppressed. In light of suppression of spin, the difference (H4−H2) is preferably equal to or greater than 20, more preferably equal to or greater than 30, and particularly preferably equal to or greater than 35. The difference (H4−H2) is preferably equal to or less than 60. In light of suppression of spin, the difference (H6−H4) is preferably equal to or greater than 1, more preferably equal to or greater than 5, and particularly preferably equal to or greater than 8. The difference (H6−H4) is preferably equal to or less than 20.

In light of feel at impact, the amount of compressive deformation of the golf ball 2 is preferably equal to or greater than 2.0 mm, more preferably equal to or greater than 2.1 mm, and particularly preferably equal to or greater than 2.2 mm. In light of resilience performance, the amount of compressive deformation is preferably equal to or less than 3.5 mm, more preferably equal to or less than 3.0 mm, and particularly preferably equal to or less than 2.6 mm.

The golf ball 2 may include a reinforcing layer between the inner cover 6 and the outer cover 8. The reinforcing layer firmly adheres to the inner cover 6 and also to the outer cover 8. The reinforcing layer prevents separation of the outer cover 8 from the inner cover 6. As described above, the outer cover 8 of the golf ball 2 is thin. When the golf ball 2 is hit by the edge of a clubface, a wrinkle is likely to occur. However, the reinforcing layer prevents a wrinkle from occurring.

For the base polymer of the reinforcing layer, a two-component cured thermosetting resin may be suitably used. Specific examples of the two-component cured thermosetting resin include epoxy resins, urethane resins, acrylic resins, polyester based resins and cellulose based resins. In light of the strength and durability of the reinforcing layer, two-component cured epoxy resins and two-component cured urethane resins are preferred.

The reinforcing layer may include additives such as a coloring agent (typically, titanium dioxide), a phosphate-based stabilizer, an antioxidant, a light stabilizer, a fluorescent brightener, an ultraviolet absorber, an anti-blocking agent and the like. The additives may be added to the base material of the two-component curing thermosetting resin, or may be added to the curing agent of the two-component curing thermosetting resin.

The reinforcing layer is obtained by applying, to the surface of the inner cover 6, a liquid which is prepared by dissolving or dispersing the base material and the curing agent in a solvent. In light of workability, application with a spray gun is preferred. After the application, the solvent is volatilized to permit a reaction of the base material with the curing agent, thereby forming the reinforcing layer.

In light of prevention of a wrinkle, the reinforcing layer has a thickness of preferably 3 μm or greater and more preferably 5 μm or greater. In light of ease of forming the reinforcing layer, the thickness is preferably equal to or less than 300 μm, more preferably equal to or less than 50 μm, and particularly preferably equal to or less than 20 μm. The thickness is measured by observing a cross section of the golf ball 2 with a microscope. When the inner cover 6 has concavities and convexities on its surface from surface roughening, the thickness of the reinforcing layer is measured at a convex part.

In light of prevention of a wrinkle, the reinforcing layer has a pencil hardness of preferably 4B or harder and more preferably B or harder. In light of reduced loss of the power transmission from the outer cover 8 to the inner cover 6 upon a hit of the golf ball 2, the reinforcing layer has a pencil hardness of preferably 3H or less. The pencil hardness is measured according to the standards of "JIS K5400".

EXAMPLES

Example 1

A rubber composition (a) was obtained by kneading 100 parts by weight of high-cis polybutadiene (trade name "BR-730", available from JSR Corporation), 5 parts by weight of zinc oxide, an adequate amount of barium sulfate, 10 parts by weight of silica (trade name "Nipsil AQ", available from TOSHO SILICA CORPORATION), 3.4 parts by weight of sulfur, 2.20 parts by weight of a vulcanization accelerator (aforementioned "NOCCELER CZ"), and 2.26 parts by weight of the other vulcanization accelerator (the aforementioned "SOXINOL DG"). This rubber composition (a) was placed into a mold having upper and lower mold halves, each of the halves having a hemispherical cavity, and heated at 150° C. for 5 minutes to obtain a center having a diameter of 5.1 mm.

A rubber composition (c) was obtained by kneading 100 parts by weight of high-cis polybutadiene (aforementioned "BR-730"), 39 parts by weight of zinc diacrylate, 10 parts by weight of zinc oxide, an adequate amount of barium sulfate, 0.5 parts by weight of diphenyl disulfide and 0.8 parts by weight of dicumyl peroxide (NOF Corporation). A half shell was formed from this rubber composition (c). The center was covered with two half shells. The center and the half shells were placed into a mold having upper and lower mold halves, each of the halves having a hemispherical cavity, and heated at 170° C. for 30 minutes to obtain a core having a diameter of 39.7 mm. The amount of barium sulfate was adjusted so that the specific gravity of the mid layer corresponded to that of the center and the weight of the ball was made to be 45.4 g.

50 parts by weight of an ionomer resin (aforementioned "Surlyn 8945") and 50 parts by weight of other ionomer resin (aforementioned "Himilan AM7329") were kneaded in a twin screw kneading extruder to obtain a resin composition (j). The core was placed into a mold which includes upper and lower mold halves, each of the halves having a hemispherical cavity. The resin composition (j) was injected around the core by injection molding to form an inner cover. The inner cover had a thickness of 1.0 mm.

A paint composition (trade name "POLIN 750LE", available from SHINTO PAINT CO., LTD.) including a two-component curing type epoxy resin as a base polymer was prepared. The base material liquid of this paint composition includes 30 parts by weight of a bisphenol A type solid epoxy resin and 70 parts by weight of a solvent. The curing agent liquid of this paint composition includes 40 parts by weight of modified polyamide amine, 55 parts by weight of a solvent, and 5 parts by weight of titanium dioxide. The weight ratio of the base material liquid to the curing agent liquid was 1/1. This paint composition was applied on the surface of the inner cover with a spray gun, and maintained at 40° C. for 24 hours to obtain a reinforcing layer. The thickness of the reinforcing layer was 10 μm.

A resin composition (q) was obtained by kneading 100 parts by weight of a thermoplastic polyurethane elastomer (the aforementioned "Elastollan XNY80A") and 4 parts by weight of titanium dioxide with a twin-screw kneading extruder. Two half shells were obtained from this resin composition (q) by compression molding. The spherical body including the core, the inner cover and the reinforcing layer was covered with this two half shells. The half shells and the spherical body were placed into a final mold which includes upper and lower mold halves each having a hemispherical cavity and which has a large number of pimples on its cavity face, and compression molding was performed to obtain an outer cover with a thickness of 0.5 mm. Dimples having a shape inverted from the shape of the pimples were formed on the outer cover. A clear paint including a two-component curing type polyurethane as a base was applied to the outer cover to obtain a golf ball of Example 1 with a diameter of 42.7 mm.

Examples 2 to 11 and Comparative Examples 1 to 6

Golf balls of Examples 2 to 11 and Comparative Examples 1 to 6 were obtained in a similar manner to Example 1 except that specifications of the center, the mid layer, the inner cover and the outer cover were as listed in Tables 4 and 5 below. Details of the rubber composition of the core are presented in Table 1 below. Details of the resin composition of the mid layer and the inner cover are presented in Table 2 below. Details of the resin composition of the outer cover are presented in Table 3 below. The golf ball according to Comparative Example 1 does not have the mid layer.

[Shot With Driver (W#1)]

A driver with a titanium head (trade name "SRIXON W505", available from SRI Sports Limited, shaft hardness: X, loft angle: 8.5°) was attached to a swing machine available from Golf Laboratory Co. The golf balls were hit under a condition to give the head speed of 50 m/sec, and distance from the launching point to the point where the ball stopped was measured. Mean values of data obtained by the measurement of 12 times are shown in Tables 6 and 7 below.

[Shot With Short Iron]

A sand wedge (SW) was attached to the swing machine available from True Temper Co. The golf balls were hit under a condition to give the head speed of 21 m/sec, and spin rate immediately after the impact was measured. Mean values of data obtained by the measurement of 12 times are shown in Tables 6 and 7 below.

[Feel at Impact]

10 golf players hit golf balls with drivers, and evaluated feel at impact of the golf balls. Then, the feel at impact was heard from the players. The evaluation was categorized as follows, based on the number of players who said "the shock was small, and the feel at impact was excellent".

A: 8 or more
B: 6-7
C: 4-5
D: less than 3

The results are shown in Tables 6 and 7 below.

TABLE 1

Compositions of core (parts by weight)

| | (a) | (b) | (c) | (d) | (e) | (f) | (g) |
|---|---|---|---|---|---|---|---|
| BR-730 | 100 | 100 | 100 | 100 | 100 | 100 | 100 |
| Zinc diacrylate | — | — | 39 | 32 | 43 | 26 | 50 |
| Zinc oxide | 5 | 5 | 10 | 10 | 10 | 10 | 10 |
| Barium sulfate | Adequate amount | Adequate amount | Adequate amount | Adequate amount | Adequate amount | Adequate amount | Adequate amount |
| Silica | 10 | 30 | — | — | — | — | — |
| Diphenyl disulfide | — | — | 0.5 | 0.5 | 0.5 | 0.5 | 0.5 |
| Dicumyl peroxide | — | — | 0.8 | 0.8 | 0.8 | 0.8 | 0.8 |
| Sulfur | 3.4 | 3.4 | — | — | — | — | — |
| Vulcanization accelerator CZ | 2.20 | 2.20 | — | — | — | — | — |
| Vulcanization accelerator DG | 2.26 | 2.26 | — | — | — | — | — |

TABLE 2

Compositions of mid layer and inner cover (parts by weight)

| | (i) | (j) | (k) | (l) |
|---|---|---|---|---|
| Surlyn 8945 | 45 | 50 | — | 40 |
| Himilan AM7329 | 45 | 50 | — | 40 |
| RabalonT3221C | 10 | — | — | — |
| Surlyn 8140 | — | — | 50 | — |
| Surlyn 9120 | — | — | 50 | — |
| LEMALLOY BX505 | — | — | — | 20 |

TABLE 3

Compositions of outer cover (parts by weight)

| | (n) | (o) | (p) | (q) |
|---|---|---|---|---|
| Elastollan XNY85A | 100 | — | 20 | — |
| ElastollanX NY97A | — | 100 | 80 | — |
| Elastollan XNY80A | — | — | — | 100 |
| Titanium dioxide | 4 | 4 | 4 | 4 |

TABLE 4

| | | Example 1 | Example 2 | Example 3 | Example 4 | Example 5 | Example 6 | Example 7 | Example 8 | Example 9 |
|---|---|---|---|---|---|---|---|---|---|---|
| Center | Composition | (a) | (a) | (b) | (a) | (b) | (a) | (b) | (a) | (a) |
| | Crosslinking temperature (° C.) | 150 | 150 | 150 | 150 | 150 | 150 | 150 | 150 | 150 |
| | Crosslinking time (min) | 5 | 5 | 5 | 5 | 5 | 5 | 5 | 5 | 5 |
| | Diameter (mm) | 5.1 | 5.1 | 8.9 | 5.1 | 13.7 | 5.1 | 8.7 | 5.1 | 5.1 |
| | Surface hardness H2 (JIS-C) | 35 | 35 | 47 | 35 | 47 | 35 | 47 | 35 | 35 |
| Mid | Composition | (c) | (c) | (c) | (c) | (c) | (c) | (f) | (e) | (c) |

TABLE 4-continued

| | | Example 1 | Example 2 | Example 3 | Example 4 | Example 5 | Example 6 | Example 7 | Example 8 | Example 9 |
|---|---|---|---|---|---|---|---|---|---|---|
| layer | Crosslinking temperature (° C.) | 170 | 170 | 170 | 170 | 170 | 170 | 170 | 170 | 170 |
| | Crosslinking time (min) | 30 | 30 | 30 | 30 | 30 | 30 | 30 | 30 | 30 |
| | Thickness (mm) | 17.3 | 17.3 | 15.4 | 17.3 | 13.0 | 17.3 | 15.0 | 17.3 | 17.7 |
| | Innermost hardness H3 (JIS-C) | 70 | 70 | 71 | 70 | 74 | 70 | 63 | 77 | 70 |
| Core | Surface hardness H4 (JIS-C) | 85 | 85 | 85 | 85 | 85 | 85 | 76 | 92 | 85 |
| | Difference (H4 − H3) | 15 | 15 | 14 | 15 | 11 | 15 | 13 | 15 | 15 |
| Inner | Composition | (j) | (j) | (k) | (l) | (j) | (j) | (j) | (j) | (j) |
| cover | Thickness (mm) | 1.0 | 1.0 | 1.0 | 1.0 | 1.0 | 1.0 | 1.5 | 1.0 | 1.0 |
| | Hardness H5 (Shore D) | 65 | 65 | 69 | 67 | 65 | 65 | 65 | 65 | 65 |
| Sphere* | Surface hardness H6 (JIS-C) | 93 | 93 | 97 | 96 | 93 | 93 | 93 | 93 | 93 |
| Outer | Composition | (q) | (n) | (n) | (n) | (n) | (p) | (n) | (n) | (n) |
| cover | Thickness (mm) | 0.5 | 0.5 | 0.5 | 0.5 | 0.5 | 0.5 | 0.5 | 0.5 | 0.1 |
| | Hardness H7 (Shore D) | 27 | 32 | 32 | 32 | 32 | 44 | 32 | 32 | 32 |
| Ball | Deformation D (mm) | 2.45 | 2.40 | 2.30 | 2.35 | 2.35 | 2.35 | 2.85 | 2.20 | 2.40 |

*spherical body including an inner cover and an outer cover

TABLE 5

| | | Example 10 | Example 11 | Compa. Example 1 | Compa. Example 2 | Compa. Example 3 | Compa. Example 4 | Compa. Example 5 | Compa. Example 6 |
|---|---|---|---|---|---|---|---|---|---|
| Center | Composition | (a) | (a) | (c) | (b) | (b) | (a) | (e) | (a) |
| | Crosslinking temperature (° C.) | 150 | 150 | 170 | 150 | 150 | 150 | 170 | 150 |
| | Crosslinking time (min) | 5 | 5 | 30 | 5 | 5 | 5 | 30 | 5 |
| | Diameter (mm) | 5.1 | 5.1 | 39.7 | 17.7 | 5.1 | 5.1 | 37.7 | 5.1 |
| | Surface hardness H2 (JIS-C) | 35 | 35 | 85 | 47 | 47 | 35 | 88 | 35 |
| Mid | Composition | (c) | (c) | — | (c) | (d) | (c) | (i) | (g) |
| layer | Crosslinking temperature (° C.) | 170 | 170 | — | 170 | 150 | 170 | — | 170 |
| | Crosslinking time (min) | 30 | 30 | — | 30 | 30 | 30 | — | 30 |
| | Thickness (mm) | 17.1 | 16.8 | — | 11.0 | 17.3 | 17.3 | 1.0 | 17.3 |
| | Innermost hardness H3 (JIS-C) | 70 | 70 | — | 77 | 64 | 70 | — | 82 |
| Core | Surface hardness H4 (JIS-C) | 85 | 85 | 85 (H2) | 85 | 74 | 85 | 85 | 97 |
| | Difference (H4 − H3) | 15 | 15 | — | 8 | 10 | 15 | — | 15 |
| Inner | Composition | (j) | (j) | (j) | (j) | (k) | (j) | (j) | (k) |
| cover | Thickness (mm) | 1.0 | 1.0 | 1.0 | 1.0 | 1.0 | 1.0 | 1.0 | 1.0 |
| | Hardness H5 (Shore D) | 65 | 65 | 65 | 65 | 69 | 65 | 65 | 69 |
| Sphere* | Surface hardness H6 (JIS-C) | 93 | 93 | 93 | 93 | 97 | 93 | 93 | 97 |
| Outer | Composition | (n) | (n) | (n) | (n) | (n) | (o) | (n) | (n) |
| cover | Thickness (mm) | 0.7 | 1.0 | 0.5 | 0.5 | 0.5 | 0.5 | 0.5 | 0.5 |
| | Hardness H7 (Shore D) | 32 | 32 | 32 | 32 | 32 | 48 | 32 | 32 |
| ball | Deformation D (mm) | 2.45 | 2.50 | 2.40 | 2.45 | 2.55 | 2.35 | 2.40 | 1.85 |

TABLE 6

| Results of evaluation | | | | | | | | | |
|---|---|---|---|---|---|---|---|---|---|
| | Example 1 | Example 2 | Example 3 | Example 4 | Example 5 | Example 6 | Example 7 | Example 8 | Example 9 |
| W#1 Flight distance (m) | 247.0 | 248.5 | 249.0 | 249.5 | 248.0 | 251.0 | 248.0 | 249.5 | 250.5 |
| SW Spin rate (rpm) | 6910 | 6572 | 6541 | 6515 | 6524 | 6350 | 6495 | 6580 | 6440 |
| Feel at impact | A | A | A | A | A | B | A | C | C |

TABLE 7

| Results of evaluation | | | | | | | | |
|---|---|---|---|---|---|---|---|---|
| | Example 10 | Example 11 | Compa. Example 1 | Compa. Example 2 | Compa. Example 3 | Compa. Example 4 | Compa. Example 5 | Compa. Example 6 |
| W#1 Flight distance (m) | 247.5 | 246.5 | 247.0 | 247.5 | 246.0 | 249.5 | 248.0 | 252.0 |
| SW Spin rate (rpm) | 6770 | 6880 | 6580 | 6485 | 6555 | 6210 | 6460 | 6720 |
| Feel at impact | A | A | B | A | A | C | B | D |

As shown in Tables 6 and 7, the golf ball of each Example is excellent in flight performance upon a shot with a driver, and spin performance and feel at impact upon a shot with a short iron. Therefore, advantages of the present invention are clearly suggested by these results of evaluation.

The golf ball according to the present invention can be used for the play at the golf course, and practice in the driving range. The description herein above is merely for illustrative examples, and various modifications can be made without departing from the principles of the present invention.

What is claimed is:

1. A golf ball comprising:

a core, an inner cover positioned outside the core, and an outer cover positioned outside the inner cover having a thickness equal to or greater than 0.15 mm and less than 0.8 mm, wherein:

the core has a center and a mid layer positioned outside the center, the mid layer has a thickness equal to or greater than 12.0 mm, the center has a diameter of 1 mm or greater and 15 mm or less, a difference (H4−H3) between a JIS-C hardness H4 of a surface of the core and a JIS-C hardness H3 of an innermost part of the mid layer is equal to or greater than 14, the hardness H4 is equal to or greater than 75 and equal to or less than 95, the hardness H4 is greater than a JIS-C hardness H2 of a surface of the center, a JIS-C hardness H6 of a surface of a spherical body including the core and the inner cover is greater than the hardness H4, a Shore D hardness H7 of the outer cover is equal to or less than 32, the center comprises a crosslinked rubber composition, and an amount of compressive deformation of the center is equal to or greater than 0.5 mm and equal to or less than 2.5 mm in which an initial load is 0.3 N and a final load is 29.4.

2. The golf ball according to claim 1, wherein: the center has a central point having a JIS-C hardness H1 of 20 or greater and 50 or less, the hardness H2 is equal to or greater than 25 and equal to or less than 75, and a difference (H2−H1) is equal to or greater than 1 and equal to or less than 15.

3. The golf ball according to claim 1, wherein the hardness H3 is equal to or greater than 45 and equal to or less than 75.

4. The golf ball according to claim 1, wherein a difference (H3−H2) between the hardness H3 and the hardness H2 is equal to or greater than 0 and equal to or less than 35.

5. The golf ball according to claim 1, wherein a difference (H4−H1) between the hardness H4 and a JIS-C hardness H1 of a central point of the center is equal to or greater than 40 and equal to or less than 65.

6. The golf ball according to claim 1, wherein a difference (H4−H2) between the hardness H4 and the hardness H2 is equal to or greater than 20 and equal to or less than 60.

7. The golf ball according to claim 1, wherein the difference (H4−H3) is equal to or less than 25.

8. The golf ball according to claim 1, wherein a Shore D hardness H5 of the inner cover is equal to or greater than 55 and equal to or less than 80.

9. The golf ball according to claim 1, wherein the hardness H6 is equal to or greater than 85 and equal to or less than 98.

10. The golf ball according to claim 1, wherein a difference (H6−H4) between the hardness H6 and the hardness H4 is equal to or greater than 1 and equal to or less than 20.

11. The golf ball according to claim 1, wherein the hardness H7 is equal to or greater than 10 and equal to or less than 32.

12. The golf ball according to claim 1, wherein a diameter of the core is 28.0 mm or greater and 40.2 mm or less.

13. The golf ball according to claim 1, wherein a thickness of the mid layer is 10 mm or greater and 20 mm or less.

14. The golf ball according to claim 1, wherein a thickness of the inner cover is equal to or less than 1.5 mm.

15. The golf ball according to claim 1, wherein an amount of compressive deformation of the core is equal to or greater than 2.3 mm and equal to or less than 4.0 mm in which an initial load is 98 N and a final load is 1274.

16. The golf ball according to claim 1, wherein an amount of compressive deformation of a spherical body including the core and the inner cover is equal to or greater than 2.3 mm and equal to or less than 4.0 mm in which an initial load is 98 N and a final load is 1274.

17. The golf ball according to claim 1, wherein an amount of compressive deformation of the golf ball is equal to or greater than 2.0 mm and equal to or less than 3.5 mm in which an initial load is 98 N and a final load is 1274.

18. The golf ball according to claim 1, wherein: the mid layer is formed by crosslinking a rubber composition which comprises a base rubber that includes a polybutadiene as a principal component.

19. The golf ball according to claim 1, wherein the center does not contain an organic peroxide.

20. The golf ball according to claim 1, wherein the hardness H2 is equal to or greater than 25 and equal to or less than 47.

21. The golf ball according to claim 1, wherein a difference (H2−H1) between the hardness H2 and a JIS-C hardness H1 of a central point of the center is equal to or greater than 1 and equal to or less than 7.

* * * * *